US005284439A

United States Patent [19]

Shike et al.

[11] Patent Number: 5,284,439

[45] Date of Patent: Feb. 8, 1994

[54] IGNITING DEVICE

[76] Inventors: Tsutomu Shike; Toshihiko Eguchi; Masaki Saito, all of Subashiri, Oyama-cho, Sunto-gun, Shizuoka-ken, Japan

[21] Appl. No.: 910,163

[22] PCT Filed: Nov. 29, 1991

[86] PCT No.: PCT/JP91/01667

§ 371 Date: Sep. 3, 1992

§ 102(e) Date: Sep. 3, 1992

[87] PCT Pub. No.: WO92/09853

PCT Pub. Date: Jun. 11, 1992

[30] Foreign Application Priority Data

| | | | |
|---|---|---|---|
| Nov. 30, 1990 | [JP] | Japan | 2-130577 |
| Nov. 30, 1990 | [JP] | Japan | 2-130578 |
| Nov. 30, 1990 | [JP] | Japan | 2-130579 |
| Nov. 25, 1991 | [JP] | Japan | 3-96547 |
| Nov. 25, 1991 | [JP] | Japan | 3-96548 |

[51] Int. Cl.[5] ..... F23Q 7/08

[52] U.S. Cl. ..... 431/263; 431/255; 431/354; 126/401; 126/408; 126/410

[58] Field of Search ..... 431/255, 263, 345, 354; 126/409, 401-408

[56] References Cited

U.S. PATENT DOCUMENTS

| | | | |
|---|---|---|---|
| 4,502,465 | 3/1985 | Yoshinaga et al. | 126/409 |
| 4,688,551 | 8/1987 | Nakajima | 126/404 X |
| 4,920,952 | 5/1990 | Nakajima | 126/401 X |

FOREIGN PATENT DOCUMENTS

| | | |
|---|---|---|
| 56-72063 | 6/1981 | Japan . |
| 63-49167 | 4/1988 | Japan . |

*Primary Examiner*—Larry Jones

*Attorney, Agent, or Firm*—Brumbaugh, Graves, Donohue & Raymond

[57] ABSTRACT

An igniting device has a valve mechanism (8) which controls fuel supply from a gas reservoir, a gas injection nozzle (26) provided on a tip of a rod-like portion projecting from the valve mechanism(8) and a discharge electrode (32) which is disposed in the vicinity of the gas injection nozzle (26) and produces discharge spark to ignite the fuel gas discharged from the nozzle. A nozzle cover (30) made of non-conductive material is provided around the gas injection nozzle (26). The nozzle cover (30) is provided with a front end face (31*a*) disposed in front of the nozzle at a distance therefrom. The front end face (31*a*) is cut away at a portion opposed to the gas injection nozzle (26) and a portion opposed to the discharge electrode (32) to form an opening.

1 Claim, 6 Drawing Sheets

IGNITING DEVICE

FIELD OF THE INVENTION

This invention relates to an igniting device which injects flame from a nozzle by igniting fuel gas discharged from a built-in gas reservoir.

BACKGROUND OF THE INVENTION

In an igniting device such as an igniting rod or a table gas lighter, a flame is injected through a gas injection nozzle held on an end of a rod-like member which projects from a valve mechanism for controlling gas supply from a gas reservoir. Conventionally, the gas injection nozzle is surrounded by a metal cover having air inlet ports.

However such a structure is disadvantageous in that, since the gas injection nozzle is communicated with the outside through the air inlet ports which open downward and sideward, wind, oil, fire work or the like can enter through the air inlet ports to blow off flame and dielectric matter can adhere to the nozzle to weaken discharge spark.

Though there has been known a cap which is mounted on the tip of the gas injection nozzle to overcome the problem, mounting and demounting of cap is troublesome and there is a fear of losing the cap.

In order to mix the fuel gas discharged from the nozzle with air to improve combustibility, air must be introduced into the space around the nozzle and accordingly, the air inlet ports formed in the cover cannot be simply closed to overcome the problem described above.

In view of the foregoing observations and description, the primary object of the present invention is to provide an igniting device in which the gas injection nozzle can be protected from wind or foreign material and good combustibility of the fuel gas discharged from the nozzle can be long ensured.

DISCLOSURE OF THE INVENTION

The igniting device in accordance with the present invention comprises a gas reservoir for storing therein fuel gas, a valve mechanism which controls fuel supply from the gas reservoir, a piezoelectric unit, a gas injection nozzle provided on a tip of a rod-like portion projecting from the valve mechanism and a discharge electrode which is disposed in the vicinity of the gas injection nozzle and produces discharge spark to ignite the fuel gas discharged from the nozzle, wherein the improvement comprises a nozzle cover made of non-conductive material and provided around the gas injection nozzle, the nozzle cover having a front end face disposed in front of the nozzle at a distance therefrom, the front end face being cut away at a portion opposed to the gas injection nozzle and a portion opposed to the discharge electrode to form an opening.

In the igniting device in accordance with the present invention, the nozzle cover disposed around the gas injection nozzle is provided with a frond end face forward of the gas injection nozzle except the portions opposed to the gas injection nozzle and the discharge electrode. The front end face prevents smoke of fire work, wind, oil and the like from directly contacting the the gas injection nozzle, whereby foreign matter such as dielectric material is prevented from adhering to the nozzle tip to weaken discharge spark and wind or the like is prevented from blowing off the flame. Thus, in the igniting device of the present invention, the fuel gas can be steadily ignited.

PREFERRED EMBODIMENT OF THE INVENTION

Figure 1:
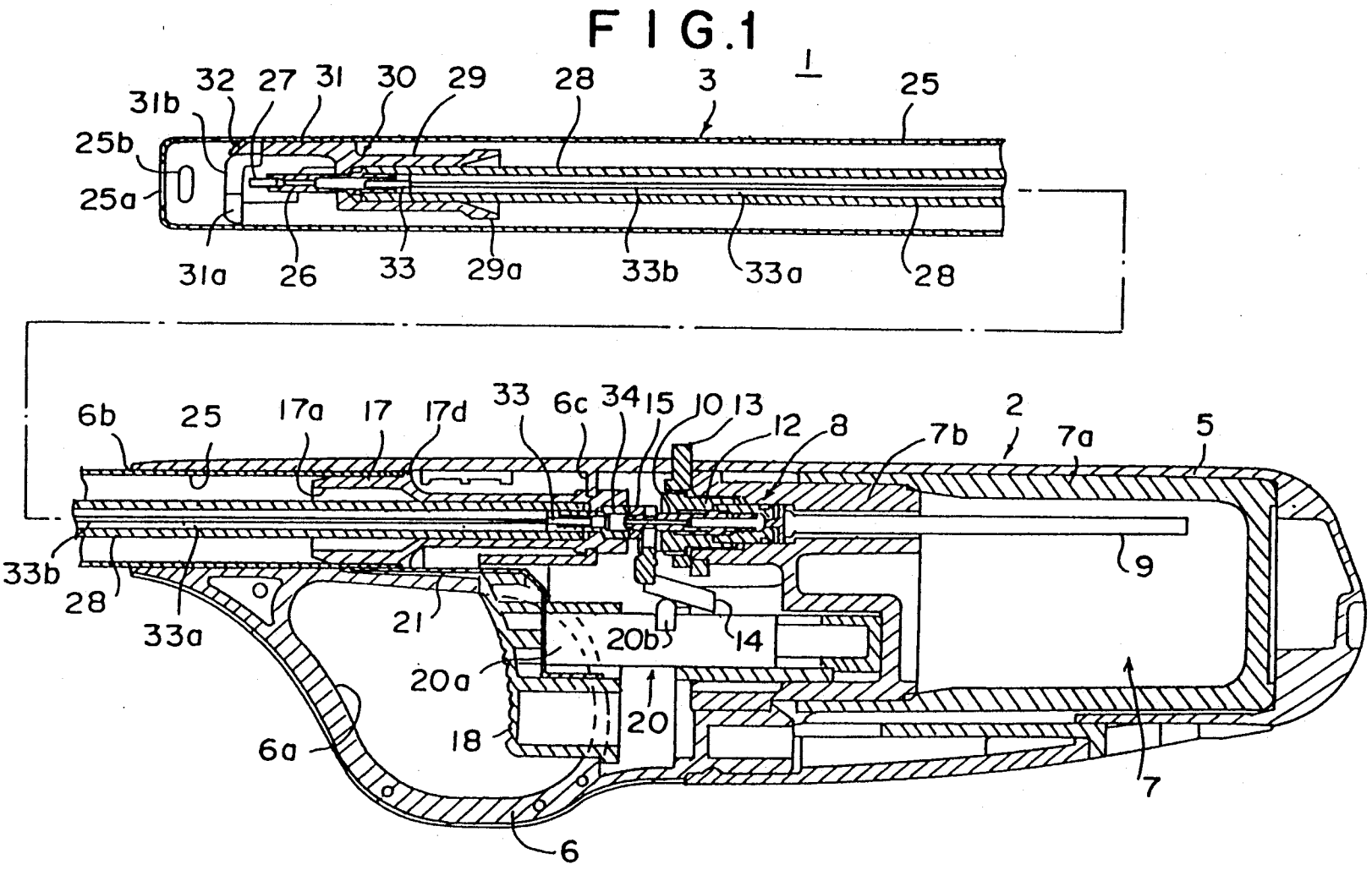
FIG. 1 is a vertical cross-sectional view of an igniting device in accordance with an embodiment of the present invention.
Figure 2:
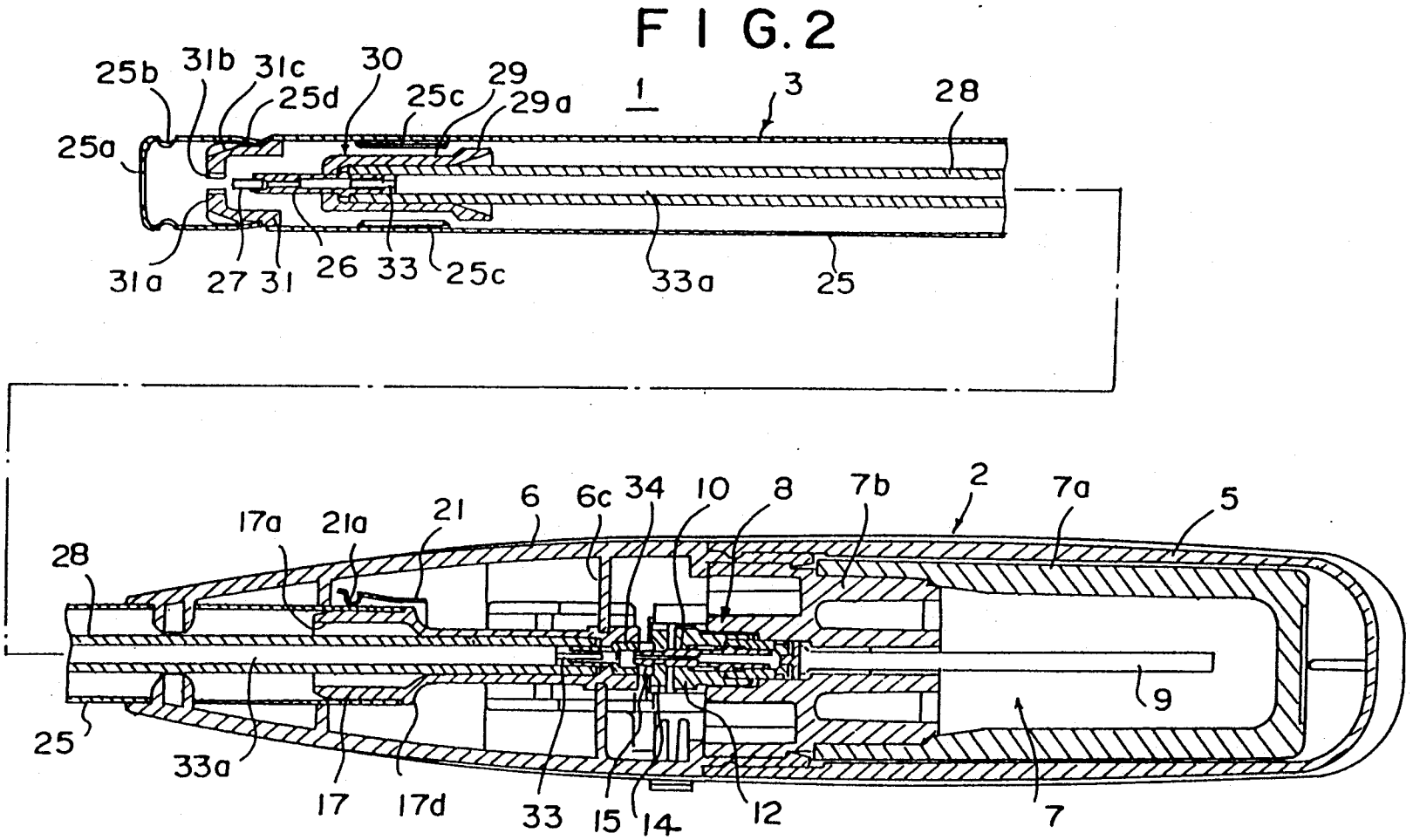
FIG. 2 is a horizontal cross-sectional view of the same.
Figure 3:
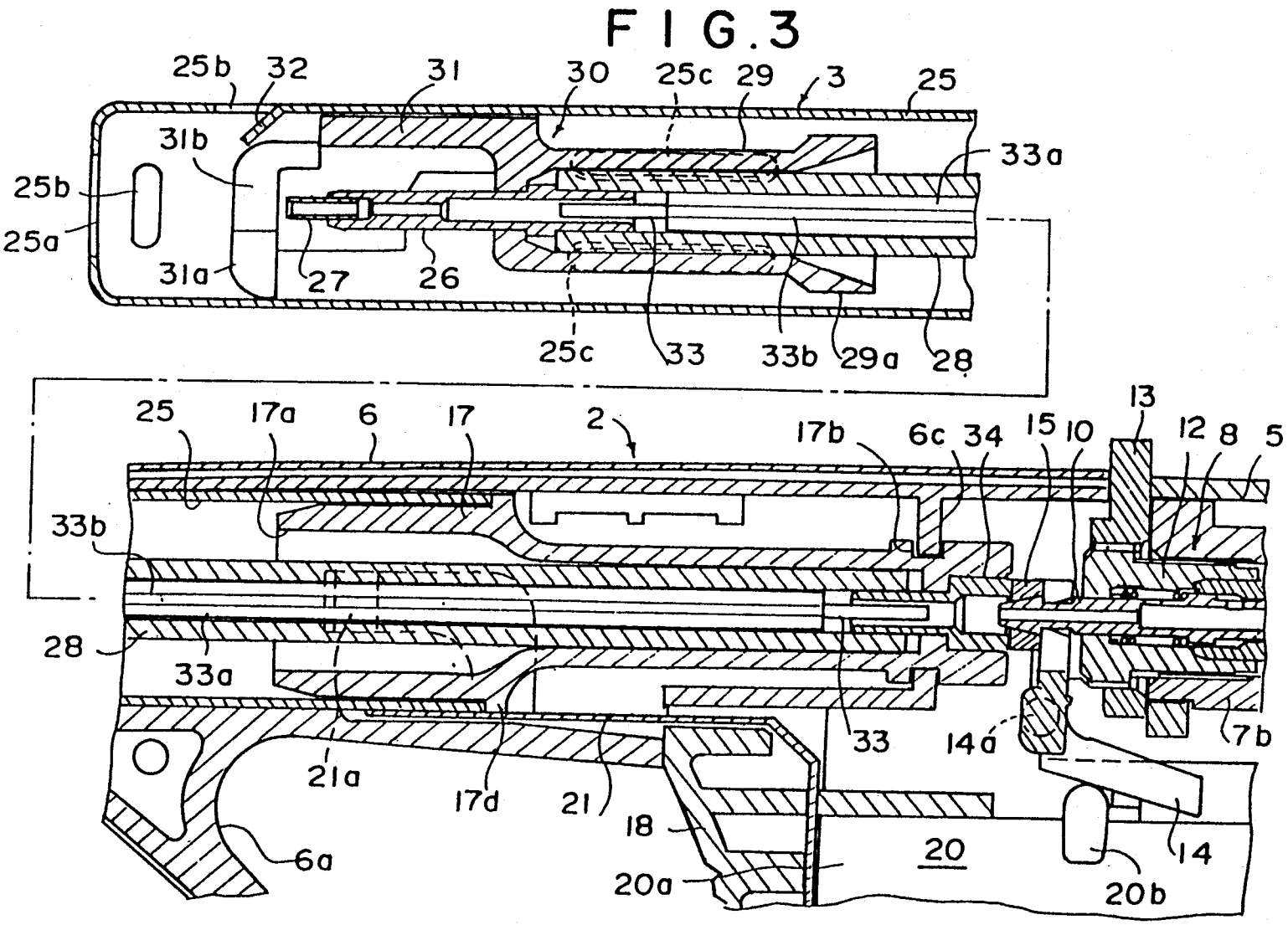
FIG. 3 is an enlarged view of a part of FIG. 1.
Figure 4:
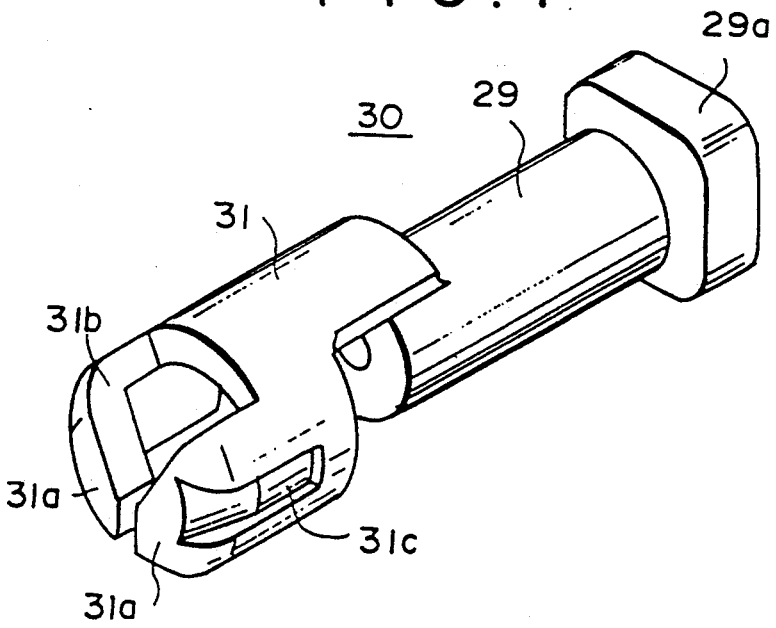
FIG. 4 is a perspective view of the nozzle cover.

Embodiments of the present invention will be described with reference to the drawings, hereinbelow. FIG. 1 is a cross-sectional view of an igniting rod in accordance with an embodiment of the present invention, FIG. 2 is a horizontal cross-sectional view of the same, and FIG. 3 is an enlarged view of a part of FIG. 1.

The igniting device 1 comprises a body portion 2 and a rod portion 3 extending from the body portion 2. In this particular embodiment, the body portion 2 and the rod portion 3 are in the form of separate units which are integrated into the igniting device 1.

The body portion 2 has a casing comprising a reservoir cover 5 and an intermediate casing 6 disposed in front of the reservoir cover 5. The reservoir cover 5 is in the form a tubular member open at the front end, and the intermediate casing 6 comprising left and right halves. The intermediate casing 6 has an opening **6*a* for accommodating an ignition lever in the lower portion thereof and an opening 6*b* in the front end thereof through which the rod portion 3 is received in the body portion 2** and connected thereto.

A gas reservoir 7 in which pressurized fuel gas is stored is accommodated in the reservoir cover 5. The gas reservoir 7 comprises a reservoir body **7*a* and an upper lid 7*b* connected to the reservoir body 7*a*. A valve mechanism 8 for controlling gas supply from the gas reservoir 7 is provided in the upper lid 7*b*. That is, a wick 9 is inserted into the gas reservoir 7 and the fuel gas is supplied through the wick 9 and a nozzle member 10 is disposed in the gas supply passage. The nozzle member 10 is urged rearward by a spring, and when the nozzle member 10 is moved forward, the gas supply passage is opened and the fuel gas is supplied, and when the nozzle member 10 is returned rearward under the force of the spring, the gas supply passage is closed and gas supply is interrupted. The amount of gas supply or the size of the flame is adjusted by rotating a flame adjustment knob 13 which is connected to an adjustment sleeve 12** and projects outward.

One end of a lever 14 for opening the nozzle member 10, i.e., for moving forward the nozzle member 10, is engaged with a front end portion of the nozzle member 10. A sealed packing 15 is mounted on the tip of the nozzle member 10 forward of the lever 14. The other end portion of the lever 14 is connected to a piezoelectric unit 20 which will be described later.

Said ignition lever 18 is mounted inside the opening 6*a* of the intermediate casing 6 to be slidable back and forth. The piezoelectric unit 20 is provided between the the ignition lever 18 and the upper lid 7*b* of the gas reservoir 7. The piezoelectric unit 20 is for supplying discharge voltage, and when the ignition lever 18 is pulled rearward, a sliding portion 20*a* is moved rearward to cause a projection 20*b* to engage with the lever 14 and rotate it and discharge voltage generated in the piezoelectric unit 20 is supplied.

That is, the lever 14 is L-shaped and is supported to rotate about a pivot 14*a*. When said the other end of the lever 14 is rotated upward in response to the rearward movement of the projection 20*b* of the sliding portion 20*a*, said one end of the lever 14 pulls forward the nozzle member 10 to open the gas supply passage. The projection 20*b* doubles as one terminal for the discharge voltage and is electrically connected to the nozzle member 10 through the lever 14 which is made of conductive resin.

The sliding member 20*a* of the piezoelectric unit 20 doubles as the other terminal for the discharge voltage and is electrically connected to a contact 21*a* by way of an earth plate 21. The contact 21*a* is disposed beside an intermediate portion of a pipe holder 17 which will be described later. That is, the earth plate 21 is sandwiched between the piezoelectric unit 20 and the ignition lever 18 at its base portion, is bent forward above the ignition lever 18, and then is cranked at portion near a flange portion 17*d* of the pipe holder 17. The front end of the earth plate 21 is formed into the contact 21*a* which is disposed on one side of the central axis of the pipe holder 17 and is pressed against the pipe holder 17 toward the central axis thereof. The earth plate 21 is moved in response to slide of the ignition lever 18.

The rod portion 3 comprises a metal tubular member 25 and a gas injection nozzle 26 which is mounted in the front end of the tubular member 25. The gas injection nozzle 26 has a nozzle tip 27 on its front end and is fitted on the front end of a gas pipe 28 at its rear end. A nozzle cover 30 is mounted on the gas injection nozzle 26 to surround it. The nozzle cover 30 is made of dielectric material such as plastics and has holder portion 29 which is fitted on the gas injection nozzle 26 and the front end portion of the gas pipe 28. The holder portion 29 has a flared rear end portion 29*a* which is square in cross-section and positioned coaxially with the tubular member 25 in contact with the inner surface of the tubular member 25.

The nozzle cover 30 is further provided with a cover portion 31 which is connected to an upper portion of the holder portion 29 and extends forward therefrom. The front end portion of the gas injection nozzle 26 projects forward from the holder portion 29 and the cover portion 31 surrounds the front end portion of the gas injection nozzle 26 at a predetermined distance therefrom except a lower portion of the gas injection nozzle 26. The cover portion 31 has a front wall portion 31*a* which extends inward in a position forwardly distant from the tip of the nozzle tip 27. The front wall portion 31*a* is cut away to form a V-shaped opening 31*b* which is flared upward from a portion substantially aligned with the nozzle tip 27. As shown in FIGS. 2 and 3, the opening 31*b* extends inward of the cover portion 31 on the side of a discharge electrode to such an extent that the nozzle tip 27 is exposed so that fuel gas is surely ignited.

Further, the opening 31*b* is extended downward in a slit-like form, thereby dividing the front wall portion 31*a* in two sectors opposed to each other as viewed from the front. A pair of engagement grooves 31*c* are formed on opposite sides of the cover portion 31 and are engaged with engagement pieces 25*d* of the tubular member 25 which are bent inward.

The tubular member 25 has a front end wall and a flame port 25*a* through which flame is injected outward is formed in the central portion of the front end wall. A plurality of air intake ports 25*b* are formed in the tubular member 25 behind the flame port 25*a*. Further, a part of the tubular member 25 is bent inward behind the air intake ports 25*b* to form a discharge electrode 32. The portion of the tubular member 25 at which the discharge electrode 32 is formed forms another air intake port 25*b*. Further four elongated air intake ports 25*c* are formed in the tubular member 25 to extend in the longitudinal direction of the tubular member 25 at portions opposed to the holder portion 29 of the nozzle cover 30.

The nozzle cover 30 is accommodated in the tubular member 25 so that the discharge electrode 32 is positioned above the V-shaped opening 31*a* thereof and the air intake port 25*b* open forward of the front wall portion 31*a* of the cover portion 31. Air introduced into the inside of the tubular member 25 through the air intake ports 25*c* formed around the holder portion 29 of the nozzle cover 30 flows into the space in the cover portion 31 through the opening which is formed in lower surface of the cover portion 31 and through which the front end portion of the gas injection nozzle 26 is exposed.

The gas pipe 28 the front end portion of which is inserted into the holder portion 29 of the nozzle cover 30 is for leading the fuel gas to the gas injection nozzle 26 and is made of hard material. The gas pipe 28 extends through the tubular member 25 along the central axis thereof and the rear end portion of the gas pipe 28 projects rearward outside the tubular member 25. The front end portion of said pipe holder 17 is fitted in the rear end portion of the tubular member 25 while the rear end portion of the gas pipe 28 is fitted in the front end portion of the pipe holder 17.

A covered wire 33 having a cover 33*a* extends through the gas pipe 28. A groove 33*b* is formed in the cover 33*a* of the covered wire 33 to extend in the longitudinal direction thereof. The cover 33*a* is removed at front and rear end portions of the covered wire 33 and the core of the covered wire 33 is exposed at the front and rear end portions.

A tubular terminal member 34 is mounted on the rear end portion of the gas pipe 28. That is, the front end portion of the terminal member 34 is fitted in the rear end portion of gas pipe 28 through the rear end of the pipe holder 17, and the rear end portion of the terminal member 34 is flared and fitted in the rear end portion of the pipe holder 17. The rear end portion of the exposed core of the covered wire 33 is connected to the terminal member 34 and the front end portion of the same is connected to the gas injection nozzle 26, whereby the terminal member 34 and the gas injection nozzle 26 are electrically connected by the covered wire 33.

The pipe holder 17 is a tubular member having a longitudinal through hole 17*a* into which the rear end portion of the gas pipe 28 is inserted. The through hole 17*a* has a large diameter at the front end portion and is smoothly tapered rearward to form a guide surface. The pipe holder 17 is further provided with an annular groove 17*b* which is formed on the outer peripheral surface of the rear end portion thereof and is adapted to be engaged with an engagement portion 6*c* formed on the inner surface of the intermediate casing 6. The sealed packing 15 mounted on the tip of the nozzle member 10 of the valve mechanism 8 is adapted to abut against the flared rear end portion of the terminal member 34. The front end portion of the pipe holder 17 is fitted in the rear end portion of the tubular member 25 and the rear end face of the tubular member 25 is in abutment against a flange portion 17*d* formed on the outer surface of the pipe holder 17.

The rod portion 3 is connected to the body portion 2 in the following manner. That is, the pipe holder 17 in which the gas pipe 28 and the tubular member 25 have been incorporated is set to one of the halves of the intermediate casing 6 of the body portion 2 so that the annular groove 17*b* of the pipe holder 17 is engaged with the engagement portion 6*c* of the intermediate casing 6, and then the other half of the intermediate casing 6 is incorporated with said one of the halves.

In the assembled state, the terminal member 34 and the nozzle member 10 are connected, and the gas passage in the gas pipe 28 and the gas passage in the valve mechanism 8 communicate with each other. Further, the contact 21*a* of the earth plate 21 is in contact with the outer surface of the tubular member 25 and the discharge electrode 32 is electrically connected with the piezoelectric unit 20. The gas injection nozzle 26 is electrically connected with the piezoelectric unit 20 by way of the nozzle member 10, the terminal member 34 and the covered wire 33. Since the discharge voltage produced by the piezoelectric unit 20 is high alternating voltage, the discharge voltage can be applied to the nozzle tip 27 even if there is a slight gap between the nozzle member 10 and the terminal member 34 or between the terminal member 34 and the exposed rear end portion of the covered wire 33.

The operation of the igniting rod 1 of this embodiment will be described, hereinbelow. When the ignition lever 18 is pulled rearward, the nozzle member 10 of the valve mechanism 8 is moved forward and the fuel gas is discharged from the gas reservoir 7 as described above. The fuel gas discharged from the gas reservoir 7 is injected from the nozzle tip 27 of the gas injection nozzle 26 through the space in the gas pipe 28 which is narrowed by the covered wire 33 inserted therein. The groove 33*b* formed on the outer surface of the covered wire 33 ensures the gas passage to the gas injection nozzle 26 even when the covered wire 33 is moved in the gas pipe 28 and the front or rear end face of the cover 33*a* is brought into contact with the end of the gas injection nozzle 26 or the terminal member 34.

Since the gas passage in the gas pipe 28 is narrowed as described above, the velocity of the fuel gas flowing therethrough is high and the fuel gas can reach the nozzle tip 27 in a short time after opening of the valve mechanism 8.

Further, in response to operation of the ignition lever 18, the piezoelectric unit 20 produces an alternating discharge voltage which is applied between the discharge electrode 32 and the nozzle tip 27 in the rod portion 3, whereby the fuel gas injected from the nozzle tip 27 is ignited.

Since the fuel gas can be stably supplied to the gas injection nozzle 26 in time by virtue of the narrowed gas passage in the gas pipe 28 and since a part of fuel injected from the nozzle tip 27 dwells in the cover portion 31 and is mixed with air introduced through the air intake ports 25*c*, the fuel gas injected from the nozzle tip 27 can be well ignited by spark produced by the discharge voltage. Further since the covered wire 33 is inserted into the gas pipe 28 at the center of the tubular member 25 which forms the ground, the distance between the ground and the wire 33 is maximized and stray capacitance in discharge of high alternating voltage is minimized, whereby leak is reduced and discharge energy is increased, thereby improving igniting performance of the igniting rod 1.

The nozzle tip 27 is positioned in the cover portion 31 of the nozzle cover 30 and is covered with the nozzle cover 30 and the tubular member 25. Accordingly, wind, oil, fire work or the like which blows off flame cannot directly act on the nozzle tip 27, and the nozzle tip 27 and the gas injection nozzle 26 are protected from foreign matter which can adhere to the nozzle tip 27 and the gas injection nozzle 26 and weaken discharge spark.

Though, in the embodiment described above, the body portion 2 and the rod portion 3 are separately formed and incorporated together later, they may be formed integrally. Further, the gas pipe 28 may be formed of flexible material though preferably it is formed of hard material. Electrical connection to the tubular member 25 may be made through a conductive wire instead of the earth plate 21.

Figure 5:
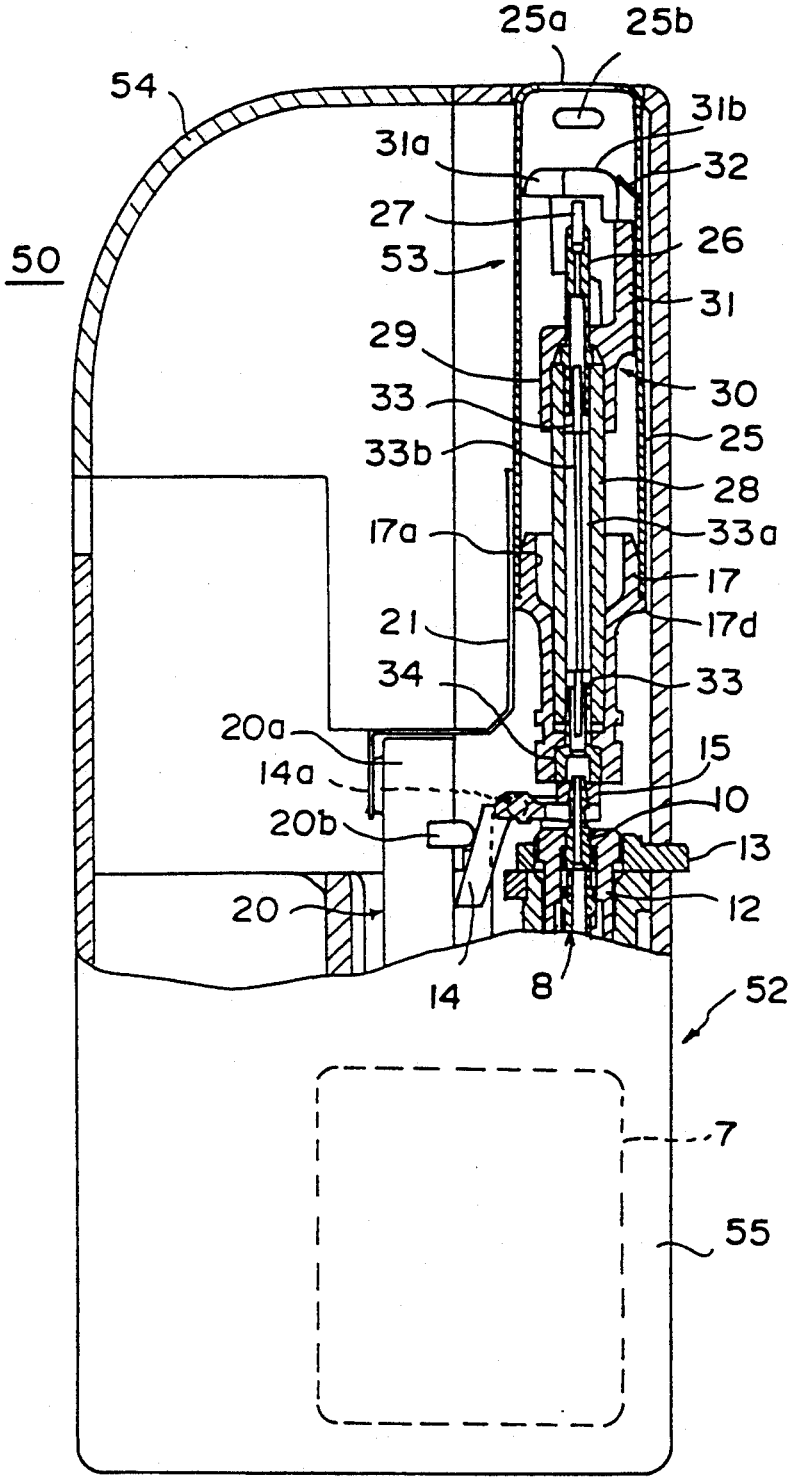
FIG. 5 is a side view partly in cross-section showing an igniting device in accordance with another embodiment of the present invention.

FIG. 5 shows another embodiment of the present invention in the form of a table gas lighter. The table gas lighter of this embodiment is basically the same as the igniting rod of the aforesaid embodiment, and accordingly the analogous parts are given the same reference numerals.

In the table gas lighter 50 of this embodiment, the casing portion 55 of the body portion 52 in which the valve mechanism 8 and the like are accommodated is shaped so that the lighter 50 can be erected. The gas reservoir 7 is shaped to conform to the shape of the casing portion 55. The ignition lever 54 for actuating the piezoelectric unit 20 provided in the body portion 52 is movable up and down, and the valve mechanism 8 is opened and the piezoelectric unit 20 is actuated to produce the discharge voltage in response to depression of the ignition lever 54. Further the igniting lever 54 forms an upper part of the casing portion 55.

Though the rod portion 53, i.e., the tubular member 25 and the gas pipe 28, is shorter than that of the aforesaid embodiment, the gas injection nozzle 26, the nozzle cover 30, the covered wire 33 and the like are the substantially same as in the aforesaid embodiment in shape and function.

Figure 6:
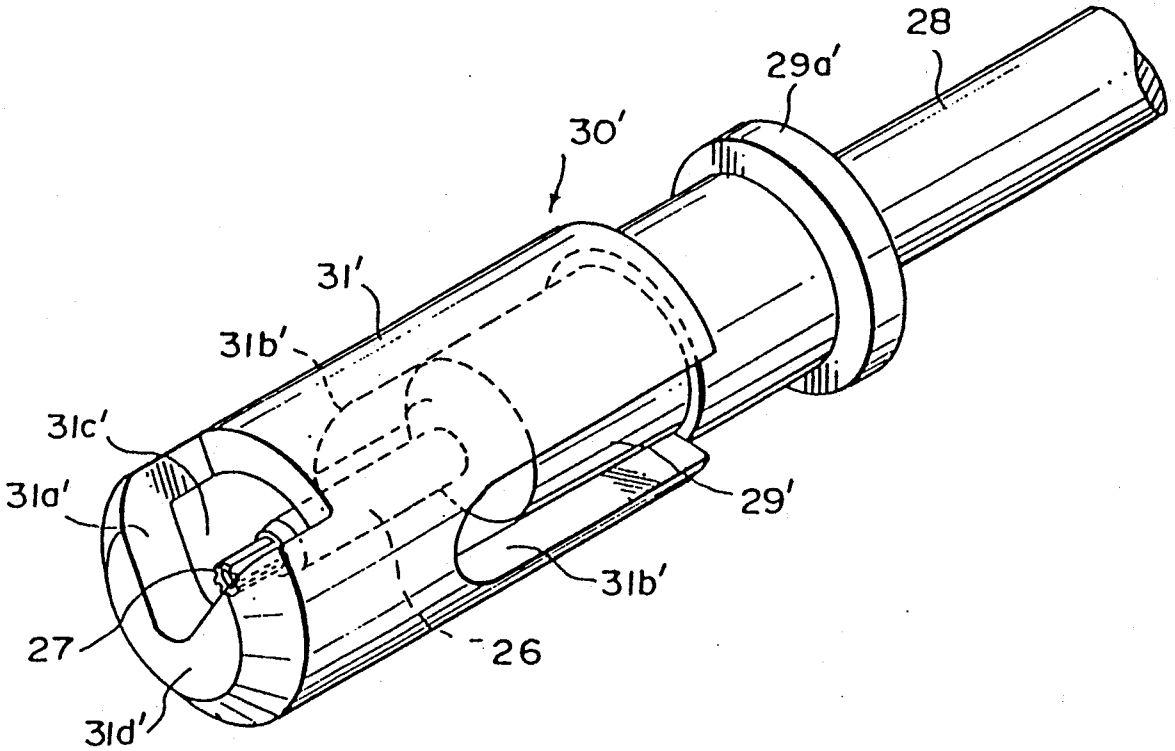
FIG. 6 is an enlarged perspective view showing the tip of the rod portion in still another embodiment of the present invention with the tubular member removed.

FIG. 6 shows the front end portion of the rod portion 3 of an igniting rod in accordance with still another embodiment of the present invention with the tubular member 25 removed. The nozzle cover 30' shown in FIG. 6 comprises a holder portion 29' and a cover portion 31' which are formed separately from each other unlike the nozzle cover shown in FIG. 1 where the holder portion 29 and the cover portion 31 are integrally formed.

The holder portion 29' is tubular in shape and is fitted on the front end portion of the gas pipe 28 and the rear end portion of the gas injection nozzle 26 with the front end portion of the gas injection nozzle 26 projecting forward from the front end of the holder portion 29'. The holder portion 29' is provided with a flange portion 29*a*' on the outer peripheral surface of the rear end portion thereof, and the flange portion 29' is in contact with the inner surface of the tubular member 25 which is not shown in FIG. 6. The cover portion 31' is like a cap in shape and is fitted on the front end portion of the holder portion 29' to extend forward about the front end portion of the gas injection nozzle 26 and the nozzle tip 27.

The cover portion 31' has a front end face **31*d'* forwardly distant from the nozzle tip 27 and a part of the front end face 31*d'* is cut away to form a V-shaped opening 31*a'* which flares upward from a portion in front of the nozzle tip 27. The cover portion 31' is further provided with a pair of cutaway portions 31*b'* which extend forward from the rear end face of the cover portion 31' on opposite sides thereof beyond the front end of the holder portion 29', whereby a pair of openings are formed on opposite sides of the cover portion 31'. When the nozzle cover 30' is inserted into the tubular member 25 shown in FIG. 1, air introduced through the air intake ports 25*c* flows into a space 31*c'* in the cover portion 31' through the openings formed by the cutaway portions 31*b'* and is mixed with a part of fuel gas injected from the nozzle tip 27**, thereby improving combustibility of the fuel gas.

The igniting rod of this embodiment is similar to the embodiment shown in FIG. 1 in the other structure. Also in this embodiment, the nozzle cover 30' prevents wind, oil, fire work or the like from blowing off the flame.

We claim:

1. An igniting device comprising a gas reservoir for storing therein fuel gas, a valve mechanism which controls fuel supply from the gas reservoir, a piezoelectric unit, a gas injection nozzle provided on a tip of a rod-like portion projecting from the valve mechanism and a discharge electrode which is disposed in the vicinity of the gas injection nozzle and produces a discharge spark to ignite the fuel gas discharged from the nozzle, wherein the improvement comprises a nozzle cover made of non-conductive material and provided around the gas injection nozzle, the nozzle cover having a front end face disposed in front of the nozzle at a distance therefrom, the front end face being cut away at a portion opposed to the gas injection nozzle, and having a portion opposed to the discharge electrode to form an opening and a tubular member substantially surrounding and engaging the nozzle cover in the region of the gas injection nozzle and having a flame port spaced forwardly from the front end face of the nozzle cover and having lateral air intake ports disposed both forwardly of the front end face of the nozzle cover and rearwardly thereof and of the gas injection nozzle.

* * * * *